US006475052B1

(12) United States Patent
Liu

(10) Patent No.: US 6,475,052 B1
(45) Date of Patent: Nov. 5, 2002

(54) BUILT-UP TOY EJECTOR

(76) Inventor: Kuo-Ching Liu, 5FL., No. 11, Alley 1, Lane 1, sec. 1, Yunhan S. Rd., Lojou City, Taipei (TW), 247

( * ) Notice: Subject to any disclaimer, the term of this patent is extended or adjusted under 35 U.S.C. 154(b) by 0 days.

(21) Appl. No.: 10/118,969

(22) Filed: Apr. 10, 2002

(51) Int. Cl.[7] ..... A63H 17/26

(52) U.S. Cl. ..... 446/88; 446/429; 446/488; 273/129 R

(58) Field of Search ..... 446/88, 93, 95, 446/429, 430, 470, 486, 487, 488; 273/129 R

(56) References Cited

U.S. PATENT DOCUMENTS 2,347,561 A * 4/1944 Howard et al. ..... 428/43
2,788,613 A * 4/1957 Gelfand et al. ..... 273/129 R
4,206,925 A * 6/1980 Goldfarb et al. ..... 273/108
5,465,961 A * 11/1995 Burtch ..... 273/317.1

* cited by examiner

*Primary Examiner*—Jacob K. Ackun
(74) *Attorney, Agent, or Firm*—Troxell Law Office PLLC

(57) ABSTRACT

A built-up toy ejector includes an ejector and a model car assembled from a plurality of flat parts. The model car has a rear contact end adapted to locate in a front end of the ejector. The ejector includes parts forming an ejecting plate and an ejecting control. The ejecting plate could be compressed to position a front end thereof in a retaining location, and the ejecting control could be operated to release the front end of the ejecting plate from the retaining location to eject the model car in front of the ejector. The flat parts for building up the ejector and the model car are initially formed on one or more boards that occupy very small space and enable the built-up toy ejector before assembling to display alone or along with other merchandise.

3 Claims, 6 Drawing Sheets

BUILT-UP TOY EJECTOR

BACKGROUND OF THE INVENTION

1. Field of the Invention

The present invention relates to a built-up toy ejector, and more particularly to a built-up toy that includes an ejector for ejecting a model car to create a dynamic effect.

2. Description of the Prior Art

A built-up toy includes a plurality of flat parts that are initially formed on a board structure by stamping and can be separated from the board structure one by one to assemble into a desired toy or model by engaging slits preformed thereon with one another.

The currently commercially available built-up toys are designed to construct only stationary and monotonous animals, plants, articles, etc., such as dinosaurs, dolls, and furniture. These built-up toys provide only still models and are therefore less interesting and attractive for play.

It is therefore desirable to develop a built-up toy that provides a dynamic effect.

SUMMARY OF THE INVENTION

A primary object of the present invention is to provide a built-up toy ejector that includes an ejector and a model car assembled from a plurality of flat parts. The ejector can be controlled to eject the model car and therefore create a dynamic effect.

Another object of the present invention is to provide a built-up toy ejector including an ejector and a model car both being assembled from a plurality of flat parts. The flat parts are initially formed on a whole piece of board by stamping and can be easily separated from the board for use. Therefore, the built-up toy ejector before being assembled into a designed form occupies only very small space and is suitable for selling alone or along with other merchandise.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
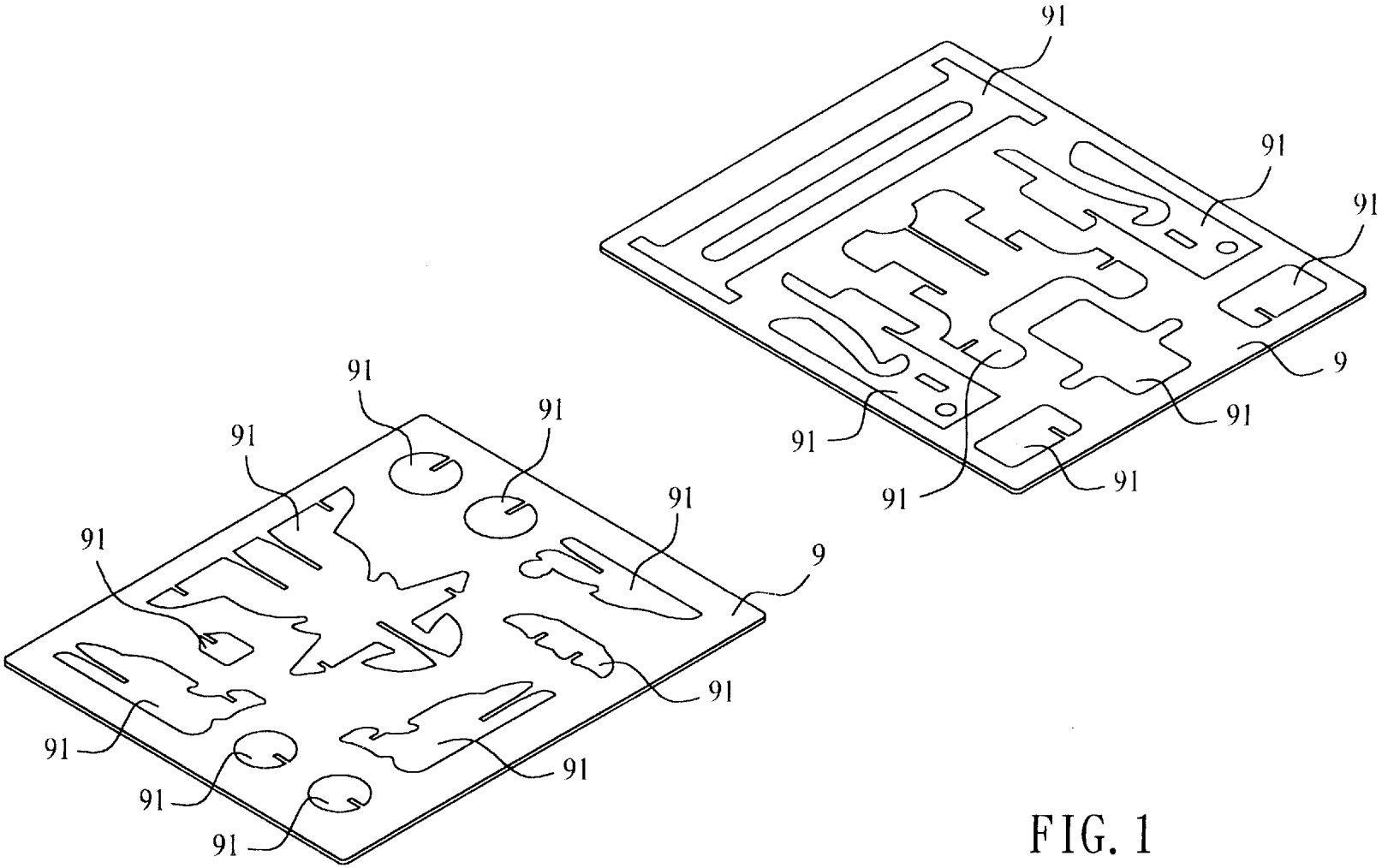
FIG. 1 shows boards containing flat parts for building up the toy ejector of the present invention.

Please refer to FIG. 1 that shows two boards 9 on which a plurality of flat parts 91 designed for assembling into a toy ejector of the present invention are formed with a stamping die. The first board 9 contains parts 91 for building up an ejector while the second board 9 contains parts 91 for building up a model car. The boards 9 may be made of plastic material or rigid paper. The boards 9 are so stamped that every part 91 can be easily separated from the boards 9 for use. It is not necessary to form the parts 91 for building up the toy ejector of the present invention on two boards 9.

It is also possible to form all the parts 91 on one single board 9 when the board 9 is manufactured.

Figure 2:
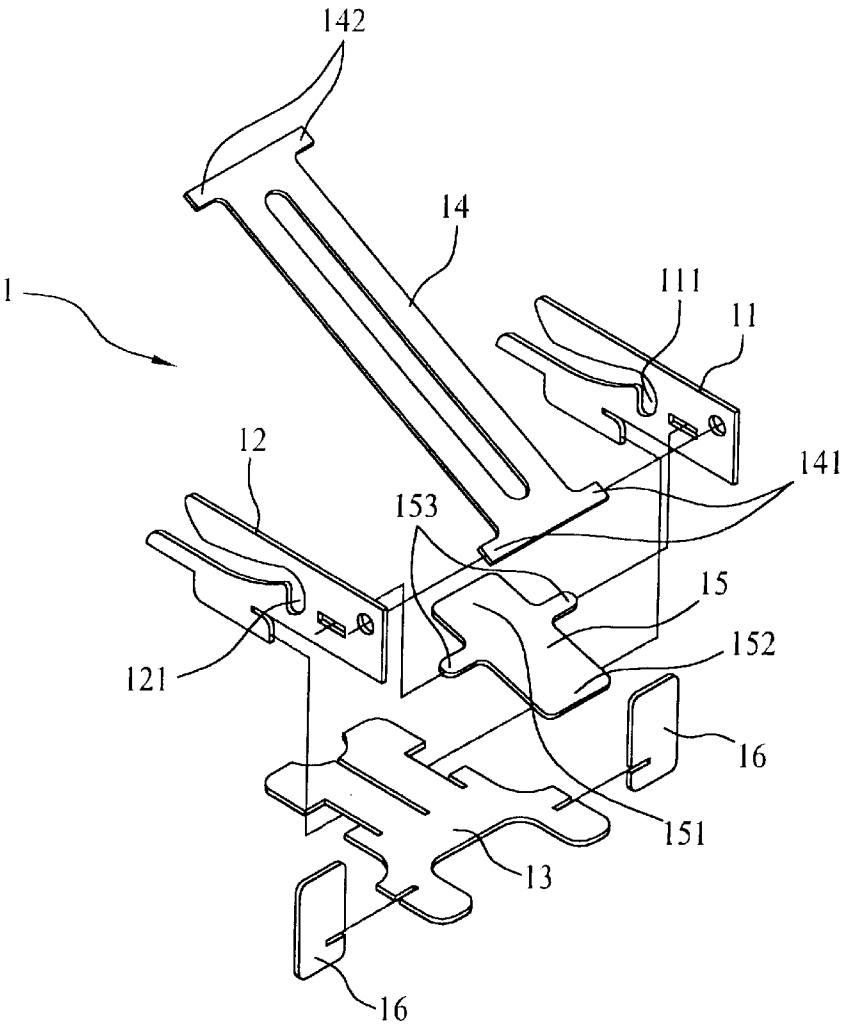
FIG. 2 is an exploded perspective view of the built-up toy ejector of the present invention.
Figure 2:
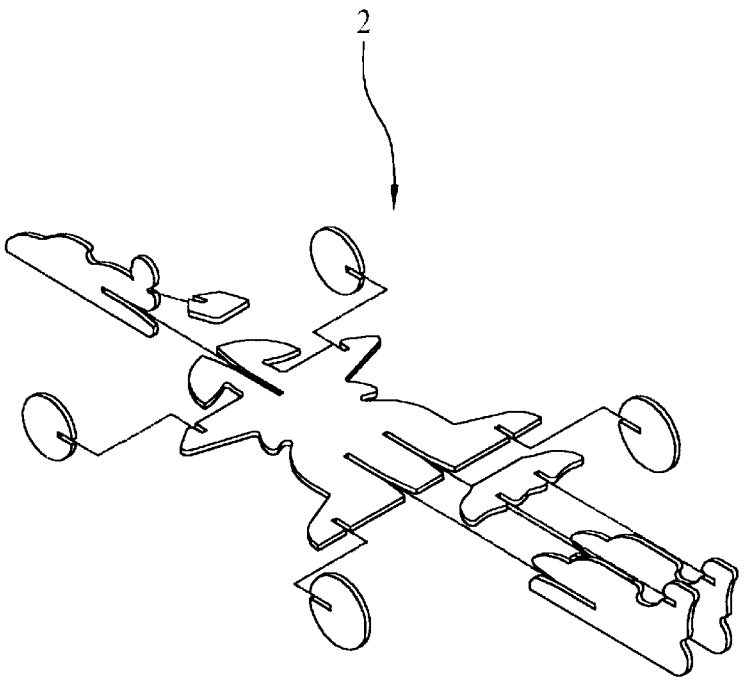
Figure 3:
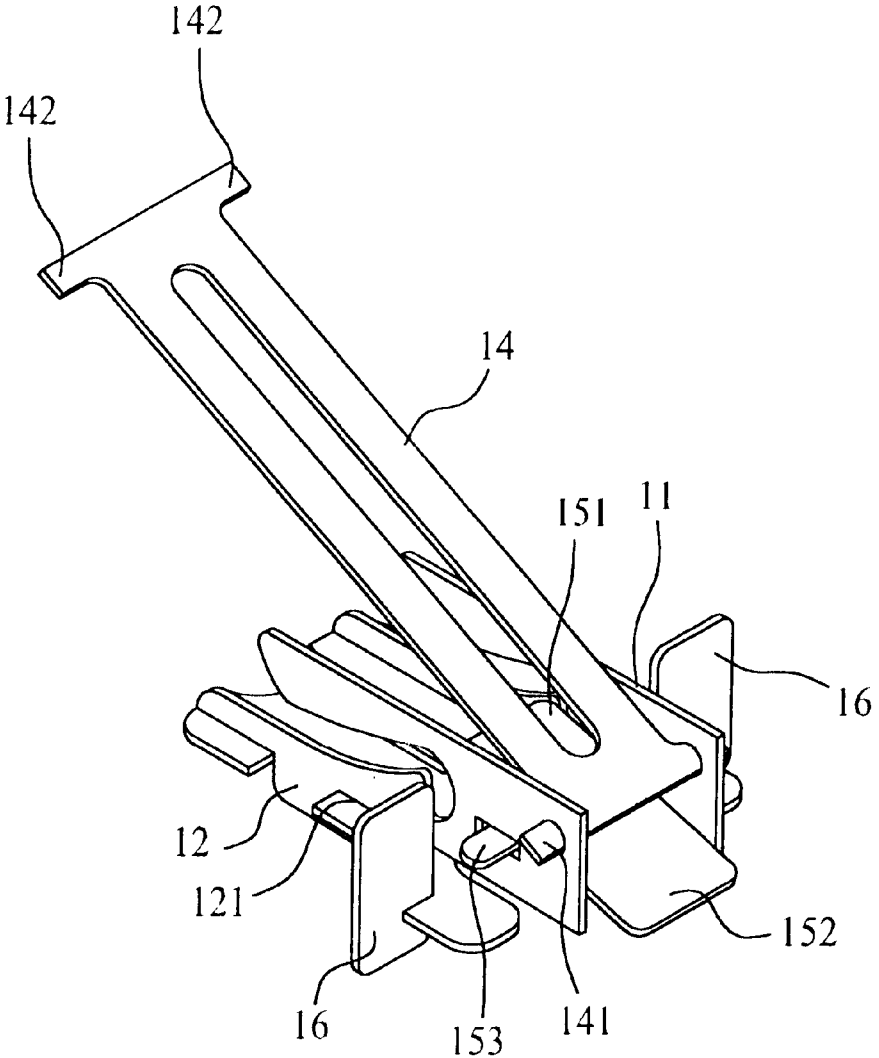
FIG. 3 is an assembled perspective view of FIG. 2.
Figure 3:
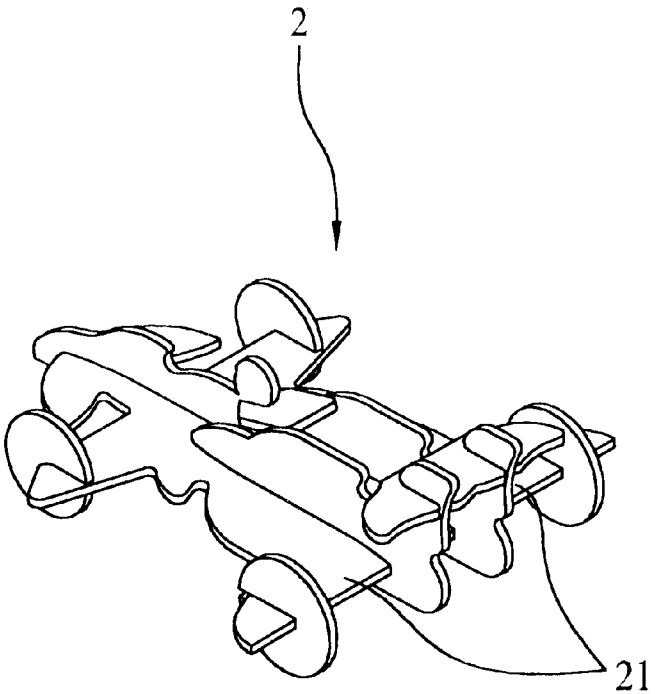

Please refer to FIGS. 2 and 3 that are exploded and assembled perspective views, respectively, of a built-up toy ejector of the present invention. As shown, the present invention includes an ejector 1 and a model car 2.

The ejector 1 is built up from two parts forming two vertical walls 11, 12, a part forming a horizontal deck 12, a part forming an ejecting plate 14, a part forming an ejecting control 15, and two parts forming two rear supports 16. The horizontal deck 13 is connected to and located between the two vertical walls 11, 12 with the two rear supports 16 separately connected to two outer rear ends thereof, so that a stable base is formed for the ejector 1. The ejecting plate 14 is provided at two corners of rear and front ends with laterally projected connectors 141 and 142, respectively. The ejecting plate 14 is located between the two vertical walls 11, 12 with the rear connectors 141 pivotally connected to upper rear ends of the two vertical walls 11, 12. The front connectors 142 of the ejecting plate 14 may be detachably positioned in two retaining slots 111, 121 separately formed on the two vertical walls 11, 12 to compressively hold the front end of the ejecting plate 14 to the vertical walls 11, 12 in place (see FIGS. 4A and 4B). The ejecting control 15 includes a front push end 151, a rear trigger end 152, and two sideward projected lugs 153 near two lateral middle points thereof. By engaging the two lugs 153 with two slits on the two vertical walls 11, 12, the ejecting control 15 is pivotally located between the vertical walls 11, 12 and below the ejecting plate 14 with the rear trigger end 152 rearward extended beyond the rear end of the ejecting plate 14 and the front push end 151 forward extended slightly beyond the retaining slots 111, 121. With the above arrangements, a downward force applied on the trigger end 152 of the ejecting control 15 would lift the push end 151 thereof to press it against the front end of the ejecting plate 14 that has been positioned in the retaining slots 111, 121 of the vertical walls 11, 12, and thereby pushes the two front connectors 142 upward to move out of the retaining slots 111, 121. At this point, a restoring force of the compressed ejecting plate 14 generates a forward push force.

The model car 2 is assembled from a plurality of flat arts 91, and a rear end of the assembled model car 2 provides a contact end 21.

Figure 4A:
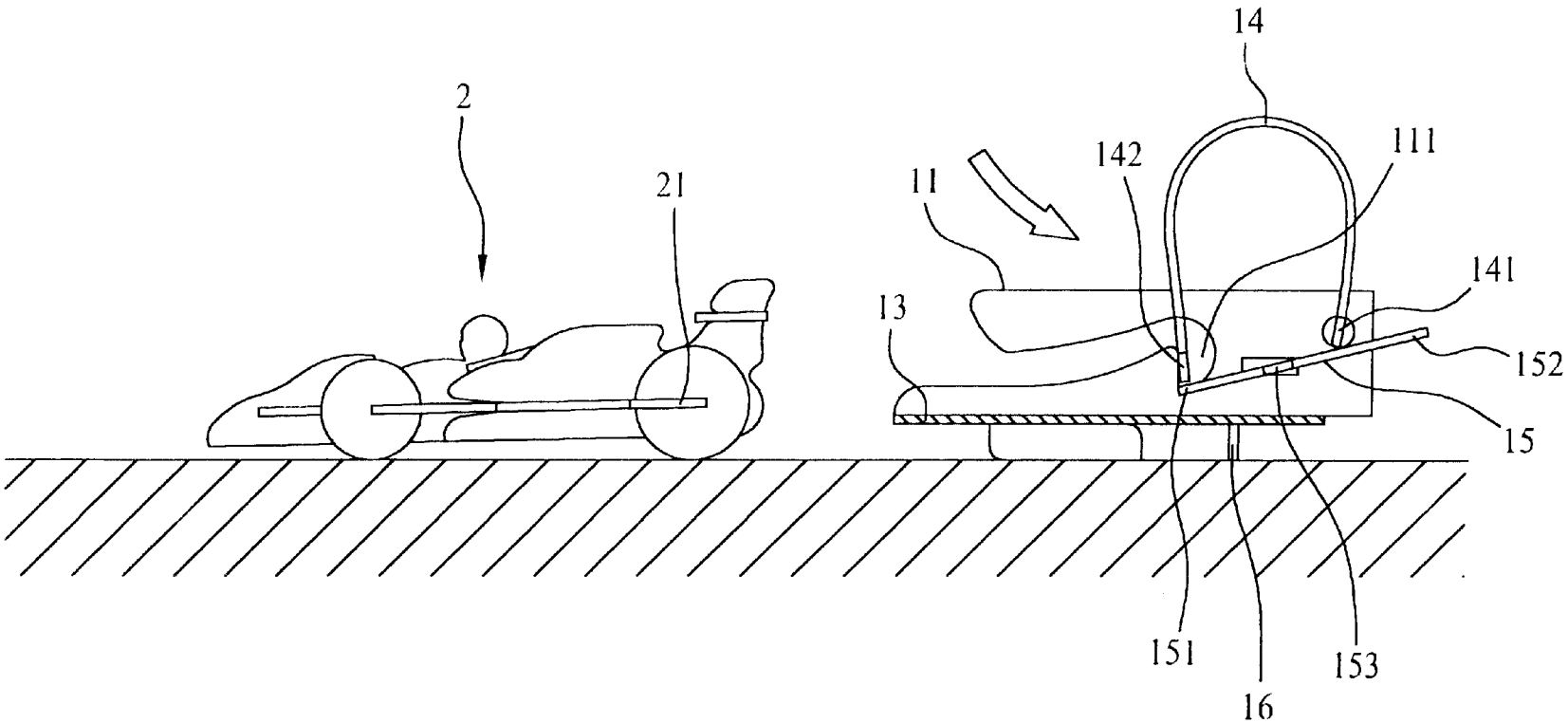
FIGS. 4A to 4C show the steps of playing the built-up toy ejector of the present invention
Figure 4B:
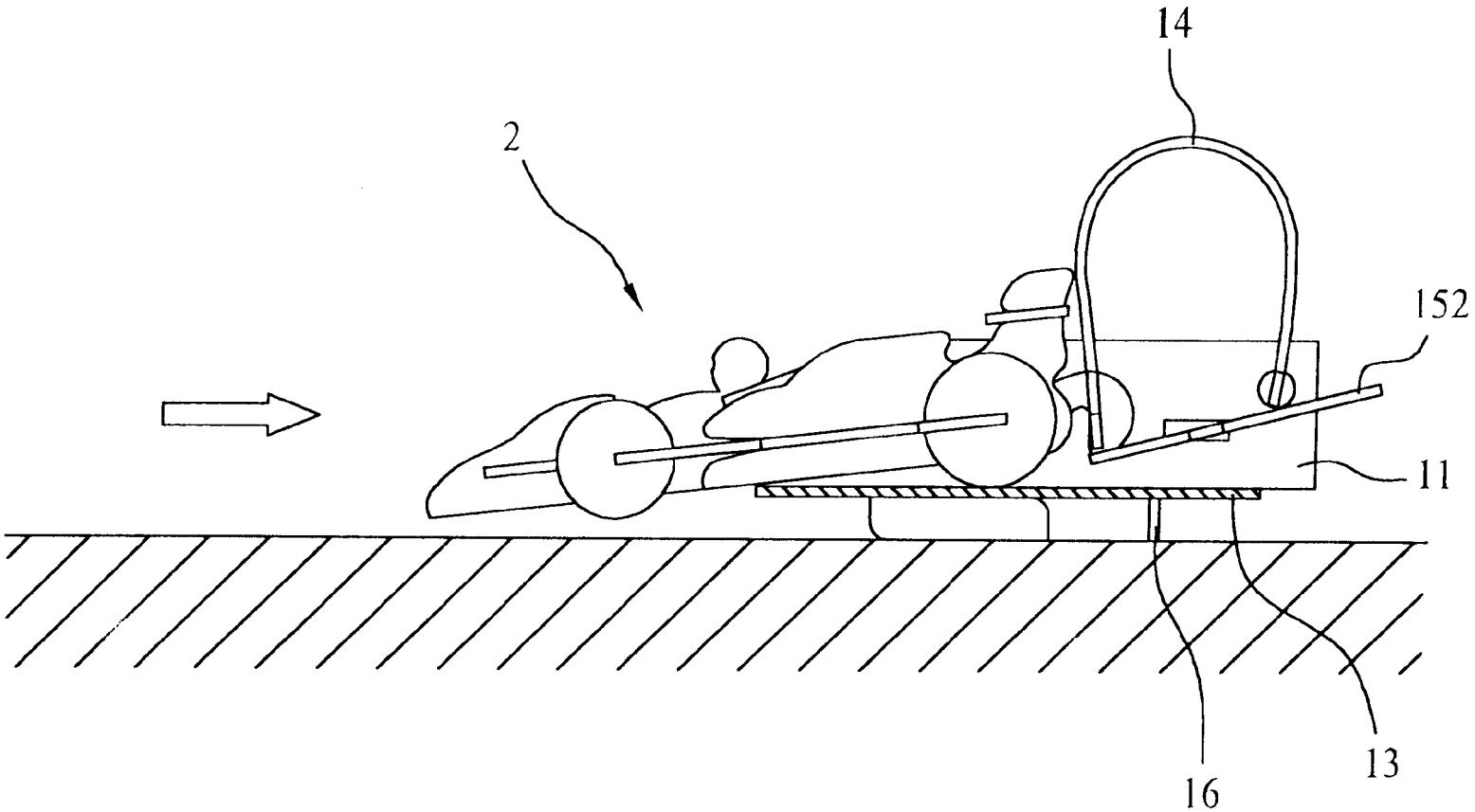
Figure 4C:
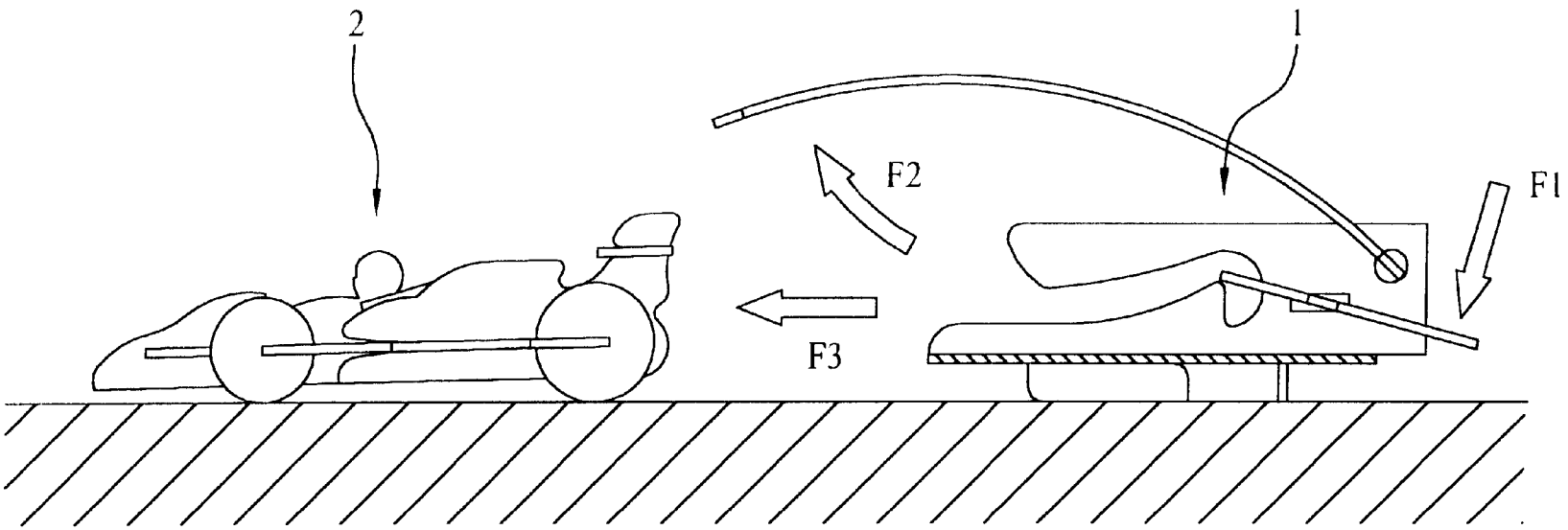

FIGS. 4A to 4C show the steps of playing the built-up toy ejector of the present invention. After the model car 2 and the toy ejector 1 are assembled from the flat parts 91 in the above-described manners, compress the ejecting plate 14 to position the two front connectors 142 in the two retaining slots 111, 121, as shown in FIG. 4A. Then, position the model car 2 between front ends of the vertical walls 11, 12 on the horizontal deck 13 of the ejector 1 with the contact end 21 located in front of the retaining slots 111, 121, as shown in FIG. 4B. And then, apply a downward force on the rear trigger end 152 of the ejecting control 15, as indicated by the arrow F1 in FIG. 4C, to release the front connectors 142 of the ejecting plate 14 from the retaining slots 111, 121. The restoring force of the compressed ejecting plate 14, in a direction as indicated by the arrow F2 of FIG. 4C, generates a push in a direction as indicated by the arrow F3 against the contact end 21 of the model car 2 to eject the model car 2.

The present invention creates a dynamic effect and is therefore more interesting and more attractive than conventional stationary built-up toys.

It is to be noted that the ejector 1 may also be used to eject other models built up from the flat parts 91, such as model airplane, model space shuttle, and other types of animals and figures. Such different combinations of the ejector 1 with different models should be included in the scope and the spirit of the prevent, invention.

What is claimed is:

1. A built-up toy ejector, comprising:

an ejector being built up from a plurality of flat parts connected to one another in a predetermined manner, one of said flat parts forming an ejecting plate that can be bent and compressed to detachably position a front end thereof in a predetermined retaining location, and another one of said flat parts forming an ejecting control that can be operated in a predetermined manner to release said front end of said ejecting plate from said retaining location; and a model car being built up from a plurality of flat parts connected to one another in a predetermined manner and having at least one end defined as a contact end for positioning before said ejector within a moving path of said front end of said ejecting plate when said front end is released from said retaining location;

whereby when said ejecting control is operated to release said front end of said compressed ejecting plate from said retaining location on said ejector, a restoring force of said compressed ejecting plate generates a push against said contact end of said model car to eject said model car.

2. The built-up toy ejector as claimed in claim 1, wherein said flat parts for assembling into said ejector and said model car are initially formed on one or more piece of boards in a predetermined manner.

3. The built-up toy ejector as claimed in claim 1, wherein said ejector includes two of said flat parts forming two vertical walls and one of said flat part forming a horizontal deck, and said horizontal deck being connected to and located between said two vertical walls to provide a stable base for said ejector; said ejecting plate being pivotally connected at a rear end to upper rear ends of said two vertical walls, and said predetermined retaining location being two retaining slots formed on said two vertical walls to detachably receive said front ends of said ejecting plate therein; and said ejecting control being pivotally connected to and between said two vertical walls with a front push end of said ejecting control forward extended slightly beyond said retaining slots and a rear trigger end of said ejecting control rearward extended beyond said rear end of said ejecting plate; whereby when said rear trigger end of said ejecting control is depressed, said front push end of said ejecting control is lifted to push said front end of said ejecting plate out of said retaining slots, allowing the restoring force of said compressed ejecting plate to eject said model car positioned before said ejector.

* * * * *